US005349763A

United States Patent [19]

Hafenrichter et al.

[11] Patent Number: 5,349,763

[45] Date of Patent: Sep. 27, 1994

[54] APPARATUS FOR DRYING HOSES, PARTICULARLY FIRE HOSES

[76] Inventors: Karl Hafenrichter, Langenfelder Str. 22, D-3262 Auetal-Hattendorf; Heinz Bormann, Westerwalder Str. 1, D-3262 Auetal-Westerwald, both of Fed. Rep. of Germany

[21] Appl. No.: 56,550

[22] Filed: May 5, 1993

[30] Foreign Application Priority Data

May 5, 1992 [DE] Fed. Rep. of Germany ..... 4214815
May 5, 1992 [DE] Fed. Rep. of Germany ..... 4214836

[51] Int. Cl.[5] ..... F26B 9/06
[52] U.S. Cl. ..... 34/104; 34/105
[58] Field of Search ..... 34/104, 15, 92, 105, 34/106, 107, 21, 18, 243 R; 15/300 R

[56] References Cited

U.S. PATENT DOCUMENTS 1,908,892 5/1933 Dietrich et al. ..... 34/104
3,965,581 6/1976 Candor ..... 34/18
5,027,531 7/1991 Wiens ..... 34/104
5,191,722 3/1993 Nayyar et al. ..... 34/104

FOREIGN PATENT DOCUMENTS 9014546.1 5/1991 Fed. Rep. of Germany .
9015172.4 6/1992 Fed. Rep. of Germany .

*Primary Examiner*—Denise Gromada
*Attorney, Agent, or Firm*—Evenson, McKeown, Edwards & Lenahan

[57] ABSTRACT

An apparatus (1) for drying the outside of hoses (2), particularly fire hoses is described, which has a pneumatic suction apparatus with suction nozzles (6) located on the hose wall below the hose (2) moved through the apparatus (1) and which is characterized in that the suction nozzles (6) are arranged in spaced succeeding manner in the movement direction of the hose (2) and that the hose (2) is curved in the vicinity of the suction nozzles (6) and that the suction nozzles (6) are externally located on the outwardly curved area of the hose surface. (cf. FIG. 1)

18 Claims, 4 Drawing Sheets

APPARATUS FOR DRYING HOSES, PARTICULARLY FIRE HOSES

Figure 1:
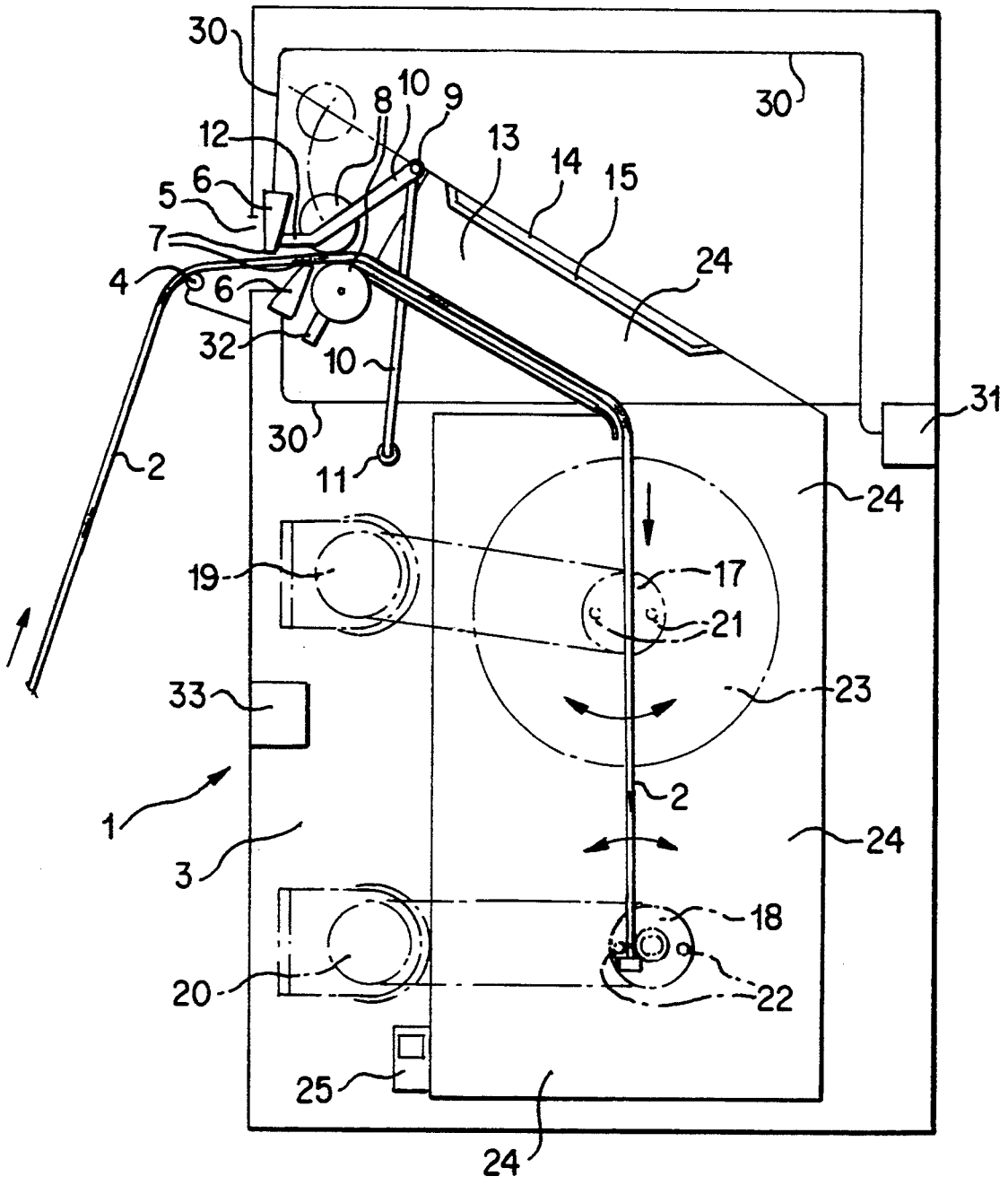

The invention relates to an apparatus for drying the outside of hoses, particularly fire hoses, which has a pneumatic suction apparatus with suction nozzles located on the hose wall above and below the hose.

It has hitherto been conventional practice to hang fire hoses up to dry in high drying towers following the use and cleaning thereof. It is disadvantage that the handling of the fire hoses involves considerable expenditure of work and that the construction of such drying towers is complicated and expensive. In addition, the building of the drying towers and the handling of the fire hoses therein takes up a large amount of space, which is not always available.

Recently German utility model 90 14 546 has disclosed a drying apparatus for fire hoses, in which moisture is sucked off by means of a pneumatic suction apparatus with nozzles located on the hose. However, it has been found that the apparatus disclosed therein does not make it possible to completely dry the hoses, i.e. to such an extent that they can be rolled up and put away. In fact, so much moisture remains in the hose wall, that the hose still has to be hung up or at least spread out for drying purposes. Thus, the drying process takes up just as much space and effort for drying purposes and in particular considerable work expenditure is still involved. The inadequate drying capacity of the known fire hose drying apparatus is in particular due to the fact that the suction nozzles arranged in overlapping facing manner on either side of the hose and spaced from the hose surface are unable to suck the liquid in optimum manner from the fabric of the hose wall. It has been found that the suction apparatus air flows acting on the hose walls on both sides and in precisely opposing manner in the vicinity of the suction openings in part neutralize their action on the hose wall.

The problem of the invention is to obviate the aforementioned disadvantages and provide an apparatus for drying hoses, particularly fire hoses, so that the said hoses are completely dry.

According to the invention this problem is solved by the features of claim 1. The further development of the invention is characterized in the subclaims.

The invention is based on the finding that the suction of the liquid contained in the textile fabric of the hose walls can be decisively favoured if the fabric is expanded, i.e. opened by an arching or deflecting of the hose walls towards the suction nozzles arranged on either side. This can be brought about in that the suction nozzles are arranged on either side in the hose movement direction, are spaced and rest on the hose surface during the suction process. Thus, the suction air flow produced by the suction nozzles only acts on one side of the hose. As the suction nozzles suck the hose against the suction opening thereof, with even a relatively small suction air quantity there is a considerable mechanical effect on the textile surface of the fire hose. There is also a deformation of the engaging hose wall, which is curved into the suction nozzle opening, the fabric structure expanding and being opened towards the outside. The consequence of this is that the water in the hose wall fabric is collected particularly satisfactorily by the air flow and can be carried along or entrained. Thus, in the vicinity of the suction nozzles of the apparatus according to the invention arranged on either side of the hose walls there is a very good and rapid drying of the hose walls.

It is advantageous for the operation of the apparatus according to the invention if the suction nozzles are spaced from one another by a distance at least corresponding to the width of the edges thereof running in the hose movement direction. This eliminates a reciprocal influencing of the oppositely directed suction air flows. In addition, the action on only one side of the hose wall gives the latter a lateral freedom of movement in the vicinity of the suction nozzles which is necessary for arching into the suction openings of the nozzles.

According to another embodiment of the invention an arching or deflection of the hose walls towards the suction nozzles is brought about in that the hose is guided in curved manner by means of guide pulleys in the vicinity of the suction nozzles. Preferably there are two guide pulleys on the hose, which guide the latter in curved manner towards the suction nozzles. Here again the fabric structure of the hose wall is expanded and opened towards the outside, so that the water in the hose wall fabric is particularly well collected by the air flow and can be entrained. Here again there is a very good and rapid drying of the hose walls in the vicinity of the suction nozzles positioned on either side thereof. This effect can be increased in that here again the hose is moved past the suction nozzles in such a way that the hose surface during the suction process is sucked on the suction openings of the suction nozzles and engages thereon.

As has been shown the fabric of the hose wall can be additionally opened and the drying process made more intense in that the guide pulley surface guiding the hose is given a convex construction. There then follows an arching and opening of the hose wall fabric in two planes.

It is also advantageous if the suction openings of the suction nozzles extend on either side over the hose width, so that on both sides are always formed open portions of the suction openings for the sucking in of dry air. The sucking in of dry air then takes place by means of an air flow directed in planned manner from the sides onto the hose surface. This effect can be assisted in that the edges of the suction opening of the suction nozzles running transversely to the hose movement direction are provided with recesses, which at the same time form constantly open intake ports for the dry air. It has been found that the uniformly distributed arrangement of such intake ports leads to an optimum suction air flow distribution.

Advantageously suction lines are guided from the suction nozzles to a wet aspirator of the pneumatic suction apparatus, where the separation of the water entrained by the air flow takes place.

Due to the fact that a motor-driven roller pair is located behind the suction nozzles in the hose movement direction and which press against the hose, there is an additional squeezing out and transfer of the liquid to the roller surface and this can lead to a further marked drying effect.

If the fire hoses are to be introduced into the apparatus in their movement direction, it is advantageous if the upper suction nozzle and the upper roller of the roller pair can be flapped away from the hose.

A further additional drying effect can be obtained in that behind the suction nozzles and the roller pair is provided a heating duct inclined downwards in the hose movement direction. The heating duct is preferably inclined by an angle of 20° to 45°, which simultaneously facilitates the conveying of the hose into the apparatus using the force of gravity. The heating duct is provided with ventilating openings on which heating rods are located. Air entering the heating duct can consequently be heated and passed over the hose surface.

The work expenditure when drying fire hoses can be considerably simplified by providing a hose winding apparatus behind the heating duct. It is particularly advantageous in this connection if the heating duct is part of a ventilating duct, which extends over the following hose winding apparatus, in that in the lower area of the ventilating duct a suction fan is provided, so that the hot air in the ventilating duct is continuously conveyed over the hose and the hose coil or roll. Therefore the hot air acts on the hose for a longer period of time. The consequence is that the hose coil is heated and the residual moisture is evaporated, possibly even after the hose coil has been removed. The hose coils can then easily be stored in the dry state, without any labour-intensive subsequent handling or treatment being required.

The invention is described in greater detail hereinafter relative to two non-limitative embodiments and the attached drawings, wherein show:

FIG. 1 A diagrammatic representation of an apparatus, whose suction nozzles rest on the hose surface during the suction process in side view.

Figure 2:
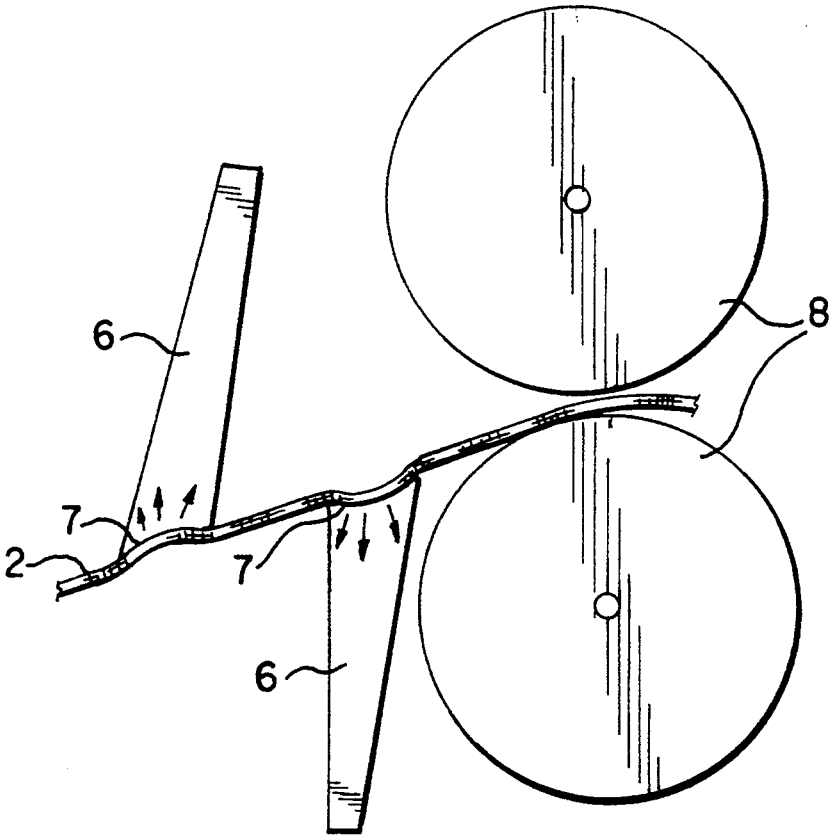

FIG. 2 The arrangement of the suction nozzles and the roller pair on the hose in the apparatus according to FIG. 1 on a larger scale.

Figure 3:
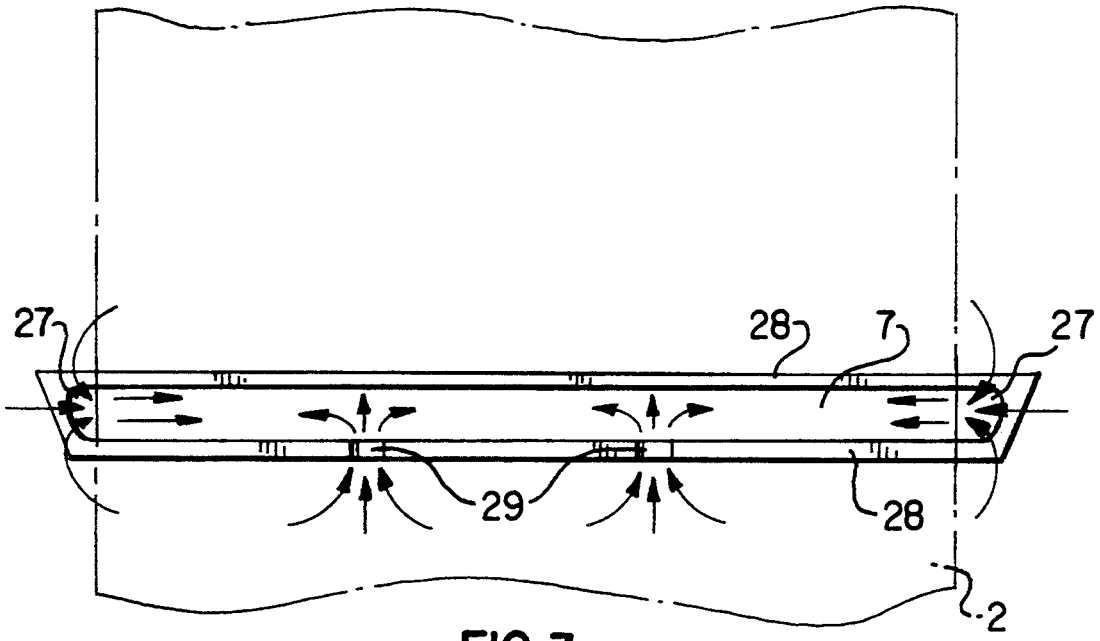

FIG. 3 A plan view of the suction opening of a suction nozzle.

Figure 4:
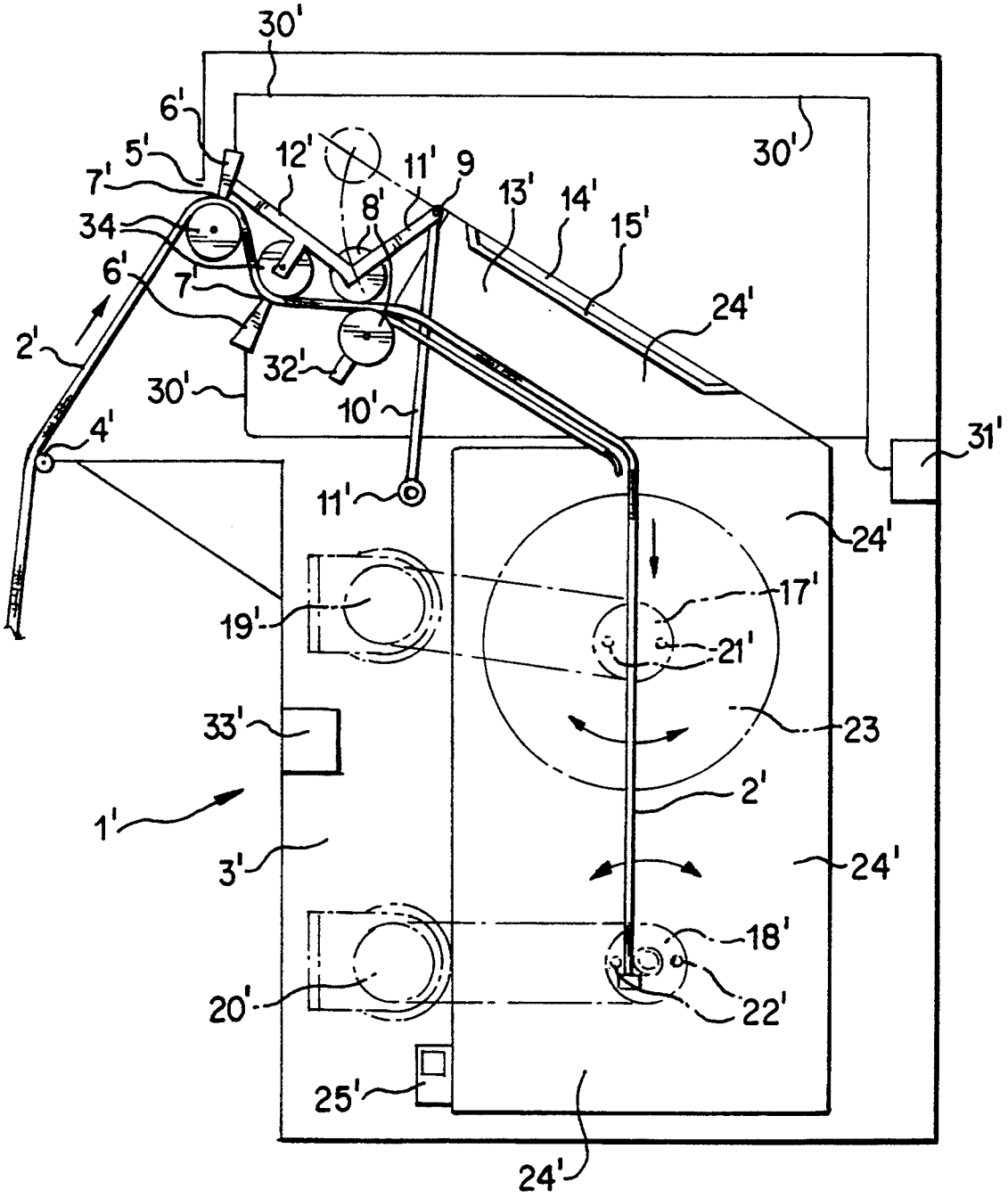

FIG. 4 A diagrammatic representation of an apparatus, in which the hose is guided in curved manner by means of guide pulleys in the vicinity of the suction nozzles, in side view.

Figure 5:
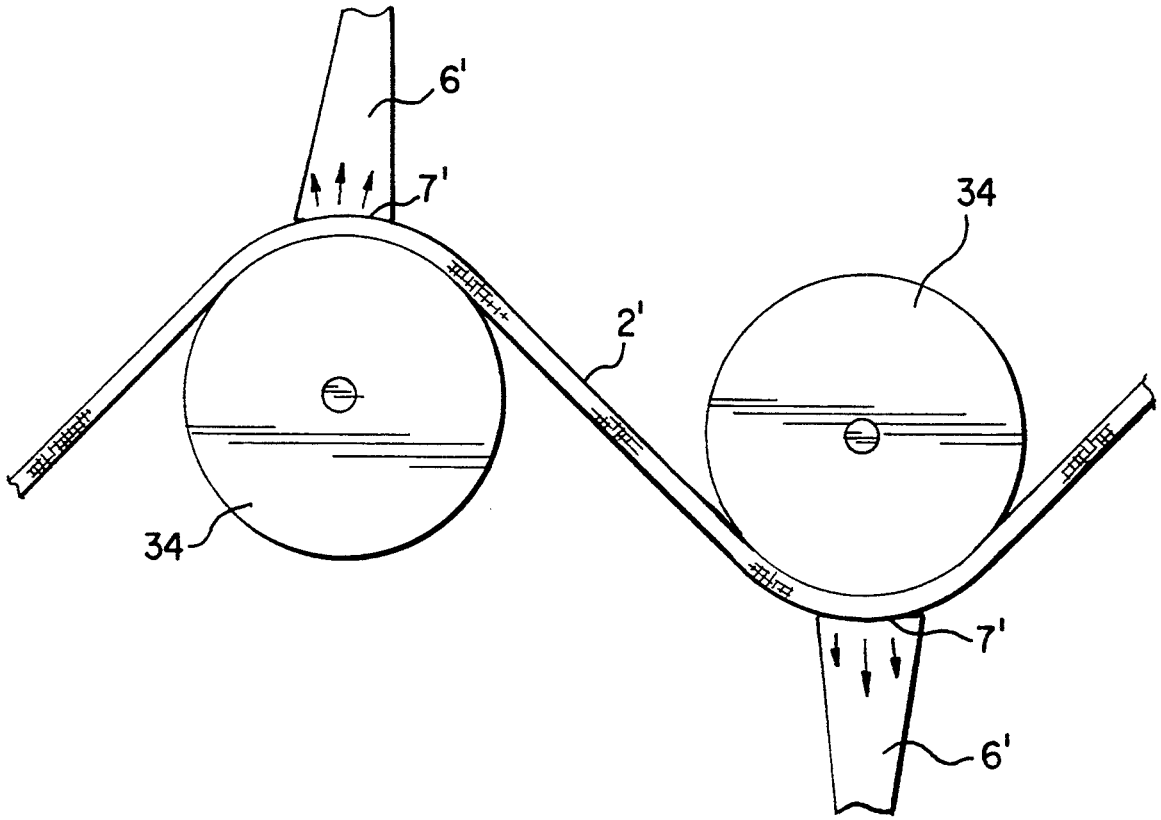

FIG. 5 The arrangement of the suction nozzles and guide pulleys on the hose in the apparatus according to FIG. 4 and on a larger scale.

In FIG. 1 1 is an apparatus for drying hoses, said apparatus 1 preferably being used for drying fire hoses. The apparatus 1 has a frame or rack 3, on which is located a guide pulley 4 for the hose 2 prior to its entrance 5 into the apparatus 1. Behind the entrance 5 there are two suction nozzles 6 in spaced succeeding manner on the top and bottom of the hose 2. During the operation of the apparatus 1 the suction nozzles 6 exert a suction action on the wall of the hose 2 by their suction openings 7.

A roller pair 8 is positioned behind the suction nozzles 6 in the movement direction of the hose 2. As a result of its own weight the upper roller of the roller pair 8 is pressed against the lower roller and/or the hose 2. The roller pair 8 is driven by means of a drive motor not shown in the drawings. The hose 2 is moved by the roller pair 8 in the apparatus 1. The upper roller of the roller pair 8 is pivotable in the upwards direction by means of a lever 10, pivotable by means of a joint 9 and having a handle 11. By means of the lever 12 the upper suction nozzle 6 is connected to the lever 10 of the roller pair 8. If the handle 11 of the lever 10 is operated, the upper roller of the roller pair 8 and the upper suction nozzle 6 are jointly moved upwards. Thus, the entrance 5 for inserting the hose 2 which, if it is a fire hose, has a hose coupling not shown in the drawings, is freed.

Behind the roller pair 8 in the apparatus 1 there is a heating duct 13 inclined downwards in the movement direction of the hose 2. The heating duct 13 is preferably inclined by an angle of 20° to 45° and through its inclination, on the basis of the force of gravity, assists the movement of the hose 2 in the apparatus 1. On the heating duct 13 are provided ventilating openings 14, behind which are positioned the heating rods 15. By means of the ventilating openings 14 dry air can enter the heating duct 13 and can be heated by means of the heating rods 15.

Behind the heating duct 13 in the movement direction of the hose 2 is provided a hose winding apparatus 16, which has two winding bodies 17, 18, which are driven by motors 19, 20. The winding bodies 17, 18 are superimposed and equipped with grippers 21, 22 for not shown hose couplings or for the centre of the hose 2. In the final phase of the winding process the hose is wound on the winding body 17 to a hose roll or coil 23, which can be removed from the apparatus 1 and stored.

According to the embodiment shown in FIG. 1 the heating duct 13 is part of a ventilating duct 24, which also extends over the following hose winding apparatus 16. In the lower area of the ventilating duct 24 is provided a suction fan 25, which draws the dry air via the ventilating openings 14 into the heating duct 13 or the ventilating duct 24 and which is passed there over the walls of the hose 2 and the hose coils in the hose winding apparatus 16. The moisture-enriched dry air is subsequently removed from the ventilating duct 24 by the suction fan 25. The described construction has the advantage that the hose 2 and also the hose coils are subject to the action of hot dry air for a longer period of time. This leads to an optimum afterdrying of the hose 2. The hose 2 is heated and, following its removal from the apparatus 1, the heated hose coil 23 leads to the evaporation of the residual moisture for a certain time.

On one face the suction nozzles 6 are provided with suction openings 7. As can be gathered from FIG. 2, during the suction process the hose 2 rests on the suction openings 7 of the suction nozzles 6. The wall of the hose 2 is drawn by the suction air into the suction openings 7 of the suction nozzles 6. As shown in FIG. 2, the wall arches into the suction openings 7. The fabric of the hose wall expands and opens to the outside. As a result the suction air flow can penetrate deeply into the fabric and very satisfactorily remove the water droplets.

As can be gathered from FIG. 3, the suction openings 7 of the suction nozzles 6 are dimensioned in such a way that on either side they extend over the width of the hose 2. On both sides this leads to the formation of open portions 27 for sucking in the dry air. The air sucked in via these portions 27 flows transversely to the movement direction of the hose 2 on the walls thereof and leads to a very effective inflow. In addition, intake ports 29 are provided in the edges 28 of the suction openings 26 running transversely to the movement direction of the hose 2 and these ports are also always open and favourably influence the distribution of the dry air on the wall of the hose 2. The arrangement and number of the intake ports 29 can be adapted to the particular requirements. It has proved advantageous if the intake ports 29 are located on the leading edge 28 of the suction opening 8 in the movement direction of the hose 2.

By means of suction lines 30 the suction nozzles 6 are connected to a wet aspirator 31 of a pneumatic suction apparatus. In the wet aspirator 31 the air sucked from the hose 2 is separated.

Apart from driving the hose 2 in the apparatus 1, the roller pair 8 is also used for measuring the hose length and is connected to a counter 32. A control device 33 for the hose winding apparatus 16 receives from the counter 32 the measured values necessary for controlling the motors 19 and 20 of the winding bodies 17, 18.

The apparatus 1' shown in FIG. 4 differs from the apparatus 1 of FIGS. 1 and 2 merely as a result of the arrangement of two guide pulleys 34 mounted in the frame 3' for the hose 2' in the vicinity of the two suction nozzles 6'. The wall of the hose 2' engages during the operation of the apparatus 1' on the suction openings 8' of the suction nozzles 6'. Here again the hose 2' is moved by the roller pair 9' through the apparatus 1'.

As can in particular be gathered from FIG. 5, in the vicinity of the suction nozzles 6' the hose 2' is deflected and curved by the two guide pulleys 34. The hose wall fabric is expanded and opened to the outside. The consequence is that the suction air flow penetrates deeply into the fabric and can very readily remove the water droplets.

In the case of a corresponding dimensioning of the suction openings 8' of the suction nozzles 6' and a corresponding high suction capacity the wall of the hose 2' is additionally drawn into the suction openings 8' of the suction nozzles 6' by the suction air. The hose wall then arches into the suction opening 8'. This leads to an increased expansion and opening of the fabric of the hose wall and therefore to an even better drying action.

During the drying process the hose wall need not necessarily be drawn into the suction openings 8' of the suction nozzles 6'. It has been found that all that is important is that the hose 2' is oppositely curved in the vicinity of the suction nozzles 6' and that the latter are externally positioned on the outwardly curved area of the hose surface. This measure in itself makes it possible to such so much liquid from the opened fabric by means of the nozzles 6' that fire hoses can be completely dried in the apparatus. It is also advantageous here if the suction openings 8' of the suction nozzles 6' are designed in accordance with FIG. 3.

We claim:

1. Apparatus for drying an outside surface of a hose having a hose wall, said hose being moved through said apparatus in a movement direction, comprising:

a pneumatic suction device having suction nozzles, said suction nozzles being successively arranged on said hose wall in the movement direction above and below said hose in a spaced manner, said hose being curved in a vicinity of said suction nozzles;

wherein each of said suction nozzles are externally positioned on an outwardly curved area of said outside surface of said hose.

2. Apparatus according to claim 1, wherein said suction nozzles include suction openings, said suction nozzles being successively arranged on both sides and in a spaced manner in said movement direction of the hose, and wherein said suction openings rest on the outside surface during a suction process.

3. Apparatus according to claim 1, wherein said suction nozzles include edges, said suction nozzles being spaced apart from one another, said spacing at least corresponding to a width of said edges extending in the movement direction of the hose.

4. Apparatus according to claim 1, further comprising guide pulleys, said guide pulleys guiding said hose in an oppositely curved manner in the vicinity of the suction nozzles.

5. Apparatus according to claim 4, wherein two guide pulleys are provided in the vicinity of the suction nozzles on said hose for guiding said hose in said oppositely curved manner.

6. Apparatus according to claim 4, wherein a surface of said guide pulleys guiding said hose is convex.

7. Apparatus according to claim 1, wherein said suction nozzles include suction opening on both sides of said hose, said suction openings extending over and beyond the width of said hose to form constantly open portions of said suction openings on either side of said hose for sucking in dry air.

8. Apparatus according to claim 1, wherein said suction nozzles include suction openings having edges, wherein said edges which run transversely to the movement direction of the hose include dry air intake ports.

9. Apparatus according to claim 1, further comprising:

a wet aspirator of said pneumatic suction device, and suction lines coupling between said suction nozzles and said wet aspirator.

10. Apparatus according to claim 1, further comprising a motor-driven roller pair positioned behind said suction nozzles in the movement direction of the hose, said roller pair pressing against one another through said hose.

11. Apparatus according to claim 10, wherein said suction nozzles include upper suction nozzles, and said roller pair includes an upper roller located behind said suction nozzles, said upper suction nozzles and said upper roller being movable away from said hose.

12. Apparatus according to claim 10, further comprising a heating duct inclined downward in the movement direction of said hose, said heating duct being located behind said suction nozzles and said roller pair.

13. Apparatus according to claim 12, wherein said heating duct is inclined at an angle of 20° to 45°.

14. Apparatus according to claim 1, further comprising:

a heating duct provided with ventilating openings, and heating rods located on said ventilating openings.

15. Apparatus according to claim 14, further comprising a hose winding apparatus positioned behind said heating duct.

16. Apparatus according to claim 15, wherein said heating duct forms part of a ventilating duct, said ventilating duct extending over said hose winding apparatus.

17. Apparatus according to claim 1, further comprising a suction fan located in a lower area of a ventilating duct.

18. Apparatus according to claim 1, further comprising:

a roller pair positioned behind the suction nozzles, a hose length counter connected to said roller pair, and a control device for a hose winding apparatus, said hose length counter being in operative connection with said control device.

* * * * *